US006966075B2

(12) United States Patent
Racine

(10) Patent No.: US 6,966,075 B2
(45) Date of Patent: Nov. 22, 2005

(54) ADJUSTABLE HELMETS

(75) Inventor: Bertrand Racine, Portland, OR (US)

(73) Assignee: Bauer Nike Hockey Inc., St-Jerome (CA)

( * ) Notice: Subject to any disclaimer, the term of this patent is extended or adjusted under 35 U.S.C. 154(b) by 441 days.

(21) Appl. No.: 10/311,790

(22) PCT Filed: Sep. 25, 2002

(86) PCT No.: PCT/CA02/01455

§ 371 (c)(1),
(2), (4) Date: Dec. 18, 2002

(87) PCT Pub. No.: WO03/026452

PCT Pub. Date: Apr. 3, 2003

(65) Prior Publication Data

US 2004/0172739 A1 Sep. 9, 2004

(30) Foreign Application Priority Data

Sep. 25, 2001 (CA) ..... 2357690

(51) Int. Cl.[7] ..... A63B 71/10; A42B 1/22
(52) U.S. Cl. ..... 2/425; 2/418
(58) Field of Search ..... 2/410, 417, 418, 2/419, 420, 425

(56) References Cited

U.S. PATENT DOCUMENTS

| | | | | |
|---|---|---|---|---|
| 1,577,183 A | | 3/1926 | Dowiarz | |
| 2,926,406 A | | 3/1960 | Edwards et al. | |
| 3,204,251 A | | 9/1965 | Child | |
| 3,447,163 A | | 6/1969 | Bothwell et al. | |
| 3,579,637 A | * | 5/1971 | Aileo | 2/418 |
| 3,629,864 A | | 12/1971 | Latina | |
| 3,665,514 A | | 5/1972 | Durand | |
| 4,404,690 A | | 9/1983 | Farquharson | |
| 4,406,021 A | | 9/1983 | Bloom | |
| 4,477,929 A | | 10/1984 | Mattsson | |
| 4,539,715 A | | 9/1985 | Clement | |
| 4,553,270 A | | 11/1985 | Hoffmann | |
| 4,555,816 A | | 12/1985 | Broersma | |
| 4,942,628 A | | 7/1990 | Freund | |
| 4,999,846 A | | 3/1991 | Ball et al. | |
| 5,077,836 A | | 1/1992 | Idoff et al. | |
| 5,094,229 A | | 3/1992 | Pomatto et al. | |
| 5,357,654 A | | 10/1994 | Hsing-Chi | |
| 5,412,814 A | | 5/1995 | Pernicka et al. | |
| 5,956,776 A | | 9/1999 | Chartrand | |
| 6,108,824 A | | 8/2000 | Fournier et al. | |
| 6,324,700 B1 | * | 12/2001 | McDougall | 2/417 |

FOREIGN PATENT DOCUMENTS

| | | | | |
|---|---|---|---|---|
| CA | 1116801 | | 1/1982 | |
| CA | 1147501 | | 6/1983 | |
| EP | 0 150 876 A2 | | 8/1985 | |
| EP | 150876 A2 | * | 8/1985 | A42B 3/00 |
| EP | 0 279 086 A1 | | 8/1988 | |
| EP | 279086 A1 | * | 8/1988 | A42B 3/00 |

* cited by examiner

*Primary Examiner*—Rodney M. Lindsey
(74) *Attorney, Agent, or Firm*—Schweitzer Cornman Gross & Bondell LLP

(57) ABSTRACT

The invention relates to an adjustable helmet comprising a first and second shell portion adjustably connected together. Each shell features a smooth interference-free sliding surface on which the two shells fit together in an overlapping relationship. The two shells are locked together by a manually operable locking device adapted to engage corresponding anchoring holes. The smooth interference-free sliding surfaces allows easy adjustment of the helmet size.

18 Claims, 7 Drawing Sheets

ADJUSTABLE HELMETS

FIELD OF THE INVENTION

The present invention relates to the field of adjustable helmets and more specifically, to locking devices used to secure the adjustable helmets in a variety of positions.

BACKGROUND OF THE INVENTION

Adjustable helmets made up of a front shell, a back shell and fastening means are well known in the field of sports equipment, and especially in the field of hockey helmets. Many of the older adjustable helmets that have a front and back shell use fastening means such as screws and bolts to hold the front and back shells together. One disadvantage of fastening means such as screws and bolts is that the wearer is forced to disassemble the two sections of the helmet in order to make the necessary adjustments to the helmet size. Often, this means that a wearer will have to make more than one adjustment to get the proper helmet size, since the adjustments cannot be made with the helmet on the wearer's head. A further disadvantage of this type of assembly is that the wearer must have the proper tools on hand, such as a screwdriver, in order to make the necessary adjustments. Often the correct tools are not readily available in situations where they are needed, namely in hockey rinks.

One attempt at an improved fastening device is demonstrated in U.S. Pat. No. 5,956,776 issued to Bauer Inc. U.S. Pat. No. 5,956,776 describes an adjustable helmet with a front shell, a back shell and a cam shaped locking device that is movable between either one of a locking position and an adjustment position. The overlapping portions of the front shell and the back shell both have engaging members that consist of parallely extending teeth. In the locked position, the two sections of extending teeth engage each other in order to prevent longitudinal displacement of the shells relative to one another. While the adjustable helmet of U.S. Pat. No. 5,956,776 enables the user to adjust the helmet while it is positioned on the wearer's head, without the need for additional tools, the parallely extending teeth create significant friction between the two shells during adjustment. This friction between the engaging teeth makes it difficult for the wearer to easily slide the two shells into a new selected position.

Clearly, there exists the need in the industry for an adjustable helmet that can not only be adjusted while positioned on a wearer's head, without additional tools, but also for a helmet having a front and back shells that can be moved easily relative to one another for accurate size adjustment.

SUMMARY OF THE INVENTION

The general object of the present invention is to provide an improved locking device for an adjustable helmet that would allow easy adjustment of the helmet size while the helmet is on a wearer's head.

A further object of the present invention is to provide an improved locking device for an adjustable helmet that eliminates the need for adjustment tools.

A still further object of the present invention is to provide an improved locking device for an adjustable helmet that is movable between a locked position and a release position wherein in the release position there are no frictional interferences between the two sliding surfaces that could obstruct the movement of the two shells.

As embodied and broadly described herein, the present invention provides an adjustable helmet comprising a first shell having smooth interference-free sliding surfaces and at least one anchoring hole, and a second shell having smooth interference-free sliding surfaces and a series of at least two anchoring holes. The second shell is adjustably connected to the first shell so that the smooth interference-free sliding surfaces of the two shells fit together in an overlapping relationship. The helmet further comprises a locking device comprising at least one tooth. The locking device is movable between a locked position and a release position wherein in the locked position the at least one tooth engages the at least one anchoring hole of the first shell, as well as at least one hole of the series of at least two anchoring holes of the second shell. In the release position the at least one tooth does not engage the at least one anchoring hole of the first shell nor the series of at least two anchoring holes of the second shell, thereby allowing the first shell and the second shell to move in relation to each other along their smooth, interference-free sliding surfaces.

As embodied and broadly described herein the present invention further provides an adjustable helmet comprising a front shell having smooth interference-free sliding surfaces and anchoring holes, and a back shell having smooth interference-free sliding surfaces and anchoring holes. The back shell is adjustably connected to the front shell so that the smooth interference-free sliding surfaces of the two shells fit together in an overlapping relationship. The helmet further provides a locking device comprising at least one tooth. The locking device is movable between a locked position and a release position wherein in the locked position the at least one tooth engages the anchoring holes of the front shell, as well as the anchoring holes of the back shell. In the release position the at least one tooth is clear of the anchoring holes of the front shell and the anchoring holes of the back shell, thereby allowing the front shell and the back shell to move in relation to each other along their smooth, interference-free sliding surfaces.

In accordance with another aspect of the invention, the present invention provides a locking device comprising a cam member adapted to pivot about an axis that extends in a direction parallel to a side portion of the adjustable helmet and a handle that extends from the cam member and is adapted to allow a user to move the locking device between the locked position and the release position.

DETAILED DESCRIPTION

Figure 1:
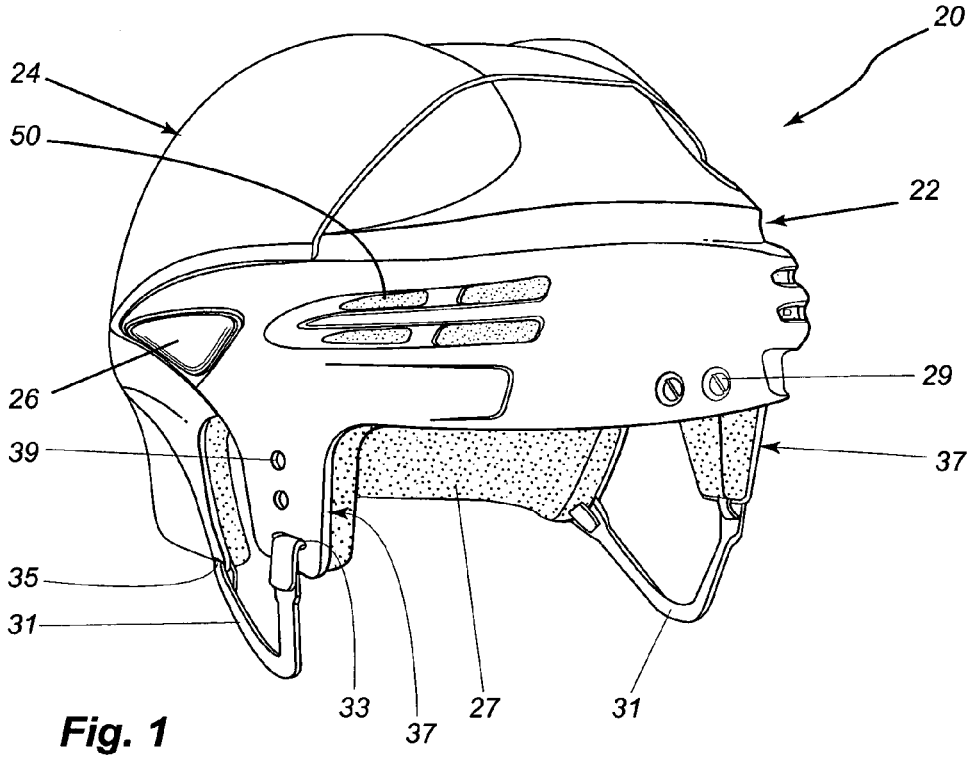
FIG. 1 is a perspective view of an adjustable helmet having a locking device according to an embodiment of the present invention.
Figure 2:
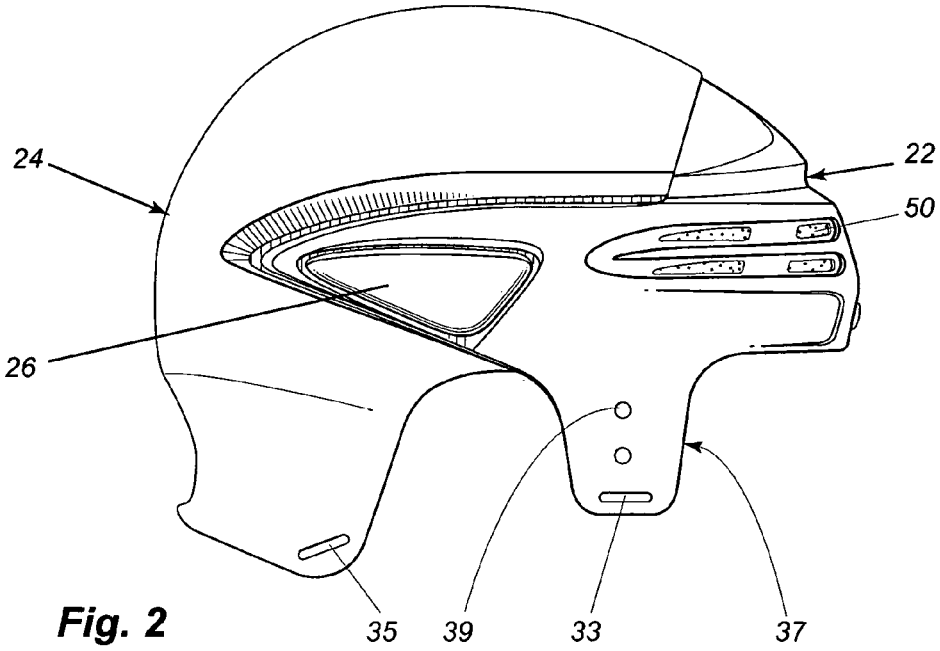
FIG. 2 is a side view of the adjustable helmet and locking device of FIG. 1.

Shown in FIGS. 1 and 2 is an adjustable hockey helmet 20 according to the present invention. Adjustable helmet 20 is made up of a front shell 22 and a back shell 24 interconnected together and adapted to move in relation to each other, and two locking devices 26 located on each side of helmet 20 just above the wearer's ears. Front shell 22 and back shell 24 are preferably made of a relatively rigid material, such as a polycarbonate material, a rigid thermoplastic, or a thermosetting resin in order to provide a strong helmet that will protect a wearer's head.

In a preferred embodiment, shown in FIGS. 1 and 2, front shell 22 includes a plurality of ventilation apertures 50 located at various positions. Although FIGS. 1 and 2 show only ventilation apertures 50 in front shell 22, it should be expressly understood that back shell 24 may also comprise ventilation apertures. While ventilation apertures 50 are not essential to the present invention, they do provide the added comfort of allowing air to circulate around the wearer's head, thus permitting perspiration to evaporate.

Also in a preferred embodiment, and as can be seen in FIG. 1, the inside of helmet 20 is lined with padding 27. Padding 27 is mounted to the inside surfaces of front shell 22 and back shell 24 in order to make helmet 20 more comfortable for the wearer. It is within the scope of the present invention for helmet 20 to have as little, or as much, padding as is necessary for the comfort of the wearer, so long it the padding does not interfere with the movement of front shell 22 and back shell 24.

Also shown in FIGS. 1 and 2, are two downwardly extending sides 37 that extend along the sides of the wearer's face in front of the wearer's ears. Sides 37 provide additional protection to the sides of the wearer's head, and further provide a useful location for connecting straps 31. At the base of sides 37 are apertures 33 (only the right hand side shows aperture 33) through which a strap 31 is looped. The other end of strap 31 is looped into a second aperture 35 located on the base of back shell 24. Helmet 20 is designed so that the wearer's ear fits into the area bounded by back shell 24, sides 37 and straps 31. Although not shown in the drawings a chin strap is adapted to be attached to each of straps 31, so that when it is secured beneath the wearer's chin, helmet 20 is securely fastened onto the wearer's head.

Front shell 22 is further equipped with holes 39, and two screws 29, both of which can be seen in FIG. 1. Holes 39 are located on downwardly extending sides 37, and screws 29 are positioned in the center of the portion of front shell 22 that covers the wearer's forehead. Although not shown in the drawings, both screws 29, and holes 39, are adapted to facilitate the attachment of a protective visor to helmet 20. Screws 29 are adapted to screw into the frame of a sports visor, and holes 39 are adapted to receive securing tabs located on the sides of the visor. Preferably, the visor is of the type wherein the transparent viewing window is hingedly connected to the frame that is screwed into helmet 20. Therefore, the visor can be moved between an upwards and downwards position. When the visor is in the down position the tabs located on the side of the visor fit inside holes 39 to keep the visor in place. And, when the wearer needs to move the visor out of his or her face, he or she must simply push the visor upwards to release the tabs from holes 39 and push the visor into the upward position.

As can be seen in FIG. 1, front shell 22 and back shell 24 are designed to be symmetric along the axis dividing the left side of helmet 20 from the right side of helmet 20. Therefore, in order to avoid repetition, only the right hand side of helmet 20 will be described for the remainder of this description. It should be understood that for all intensive purposes the left side of helmet 20 is identical to the right side of helmet 20, and therefore anything described below can be found on both sides of helmet 20.

Figure 3:
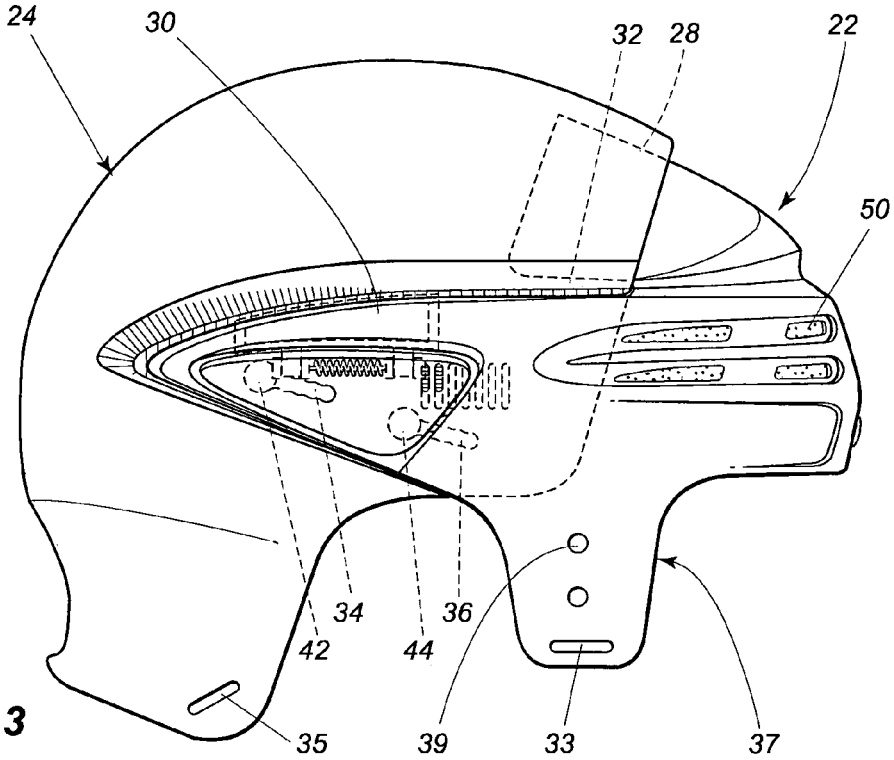
FIG. 3 is a side elevation of the adjustable helmet and locking device of FIG. 1, showing in dotted lines the mounting of the back shell to the front shell.
Figure 4:
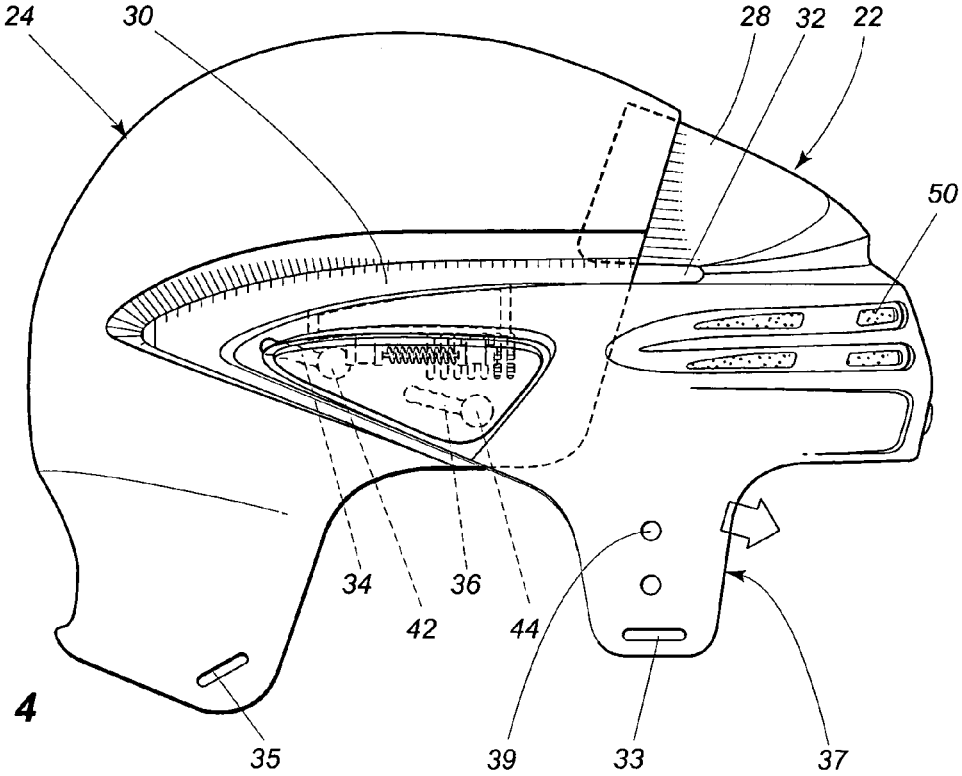
FIG. 4 is a side elevation of the adjustable helmet and locking device of FIG. 1, showing in dotted lines the mounting of the back shell to the front shell.

As can be seen in FIGS. 3 and 4, front shell 22 is divided into top section 28 and wing sections 30. Top section 28 covers the front and top of the wearer's head, and wing sections 30 extend along the sides of the wearer's head, overlapping the sides of back shell 24. Wing sections 30 are divided from top section 28 by slots 32. In a preferred embodiment, back shell 24 slides into slots 32 of front shell 22 so that wings 30 wrap around the exterior sides of back shell 24, and the top part 28 of front shell 22 lies underneath the top of back shell 24.

Both front shell 22 and back shell 24 have smooth, interference-free sliding surfaces that are adapted to be in contact with each other when helmet 20 is secured in a selected position. The interference-free sliding surfaces of the helmet still experience minor unavoidable friction, but can be moved in relation to each other without substantial interference and in a smooth movement.

The sliding surfaces for front shell 22 are located on the exterior surface of the top 28 of front shell 22 and on the interior surfaces of wings 30, while for back shell 24, the sliding surfaces are located on the interior of the top of back shell 24 and on the exterior of the sides of back shell 24. In this way the sliding surfaces of front shell 22 are in contact with the sliding surfaces of back shell 24 when helmet 20 is secured in a chosen size.

Figure 5:
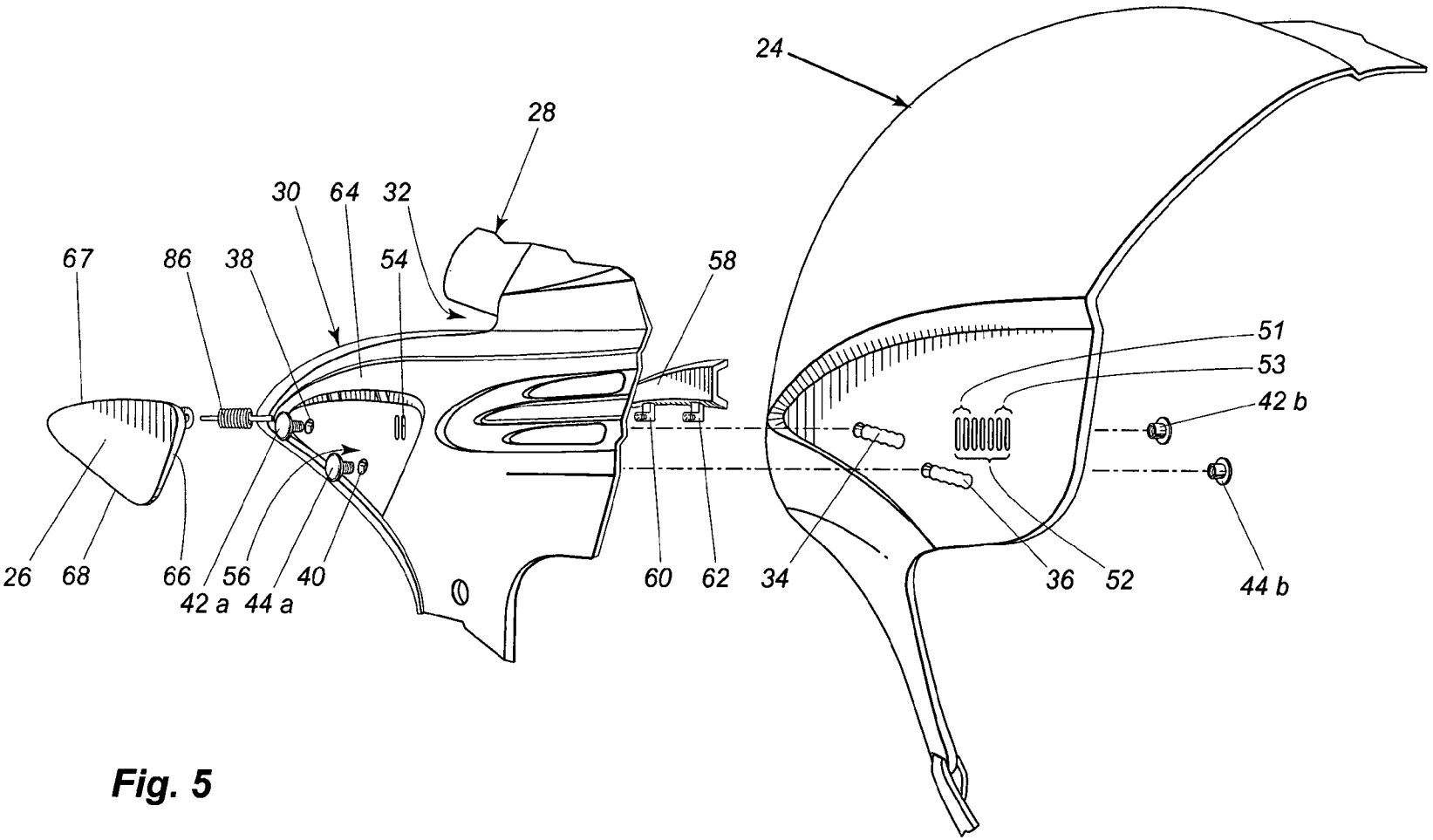
FIG. 5 is an exploded view of the adjustable helmet and locking device of FIG. 1.

Front shell 22 and back shell 24 are slidably connected to each other by a slot and peg assembly. As can be seen in FIG. 5, back shell 24 has two long slots 34 and 36, located at a position slightly above the wearer's ear. Front shell 22 has two holes 38 and 40 that align with slots 34 and 36 when front shell 22 and back shell 24 are interconnected. Pegs 42 and 44, which are both made up of two parts 42*a*, 42*b* and 44*a* and 44*b*, shown in FIGS. 5, 7 and 8, extend through slots 34 and 36 and further extend through holes 38 and 40 for assembling front shell 22 and back shell 24. Slots 34 and 36, and holes 38 and 40 have a width that is slightly greater than that of the diameter of pegs 42 and 44 so that pegs 42 and 44 can slide easily within slots 34 and 36. Pegs 42 and 44 are pieced together to assemble front shell 22 and back shell 24, and are adjusted to leave a very small gap between front and back shell 22 and 24 such that the two may slide relative to one another with minimum friction. The slot and peg assembly allows front shell 22 and back shell 24 to slide backwards and forwards and guides their relative movement. In this embodiment, back shell 24 has long slots 34 and 36 for pegs 42 and 44 to slide within and front shell 22 has holes 38 and 40. It should be expressly understood that in an alternate embodiment, both front shell 22 and back shell 24 could comprise long slots for pegs 42 and 44 to slide along. Or alternately, back shell 24 could have the two holes for pegs 42 and 44 to fit through and front shell 22 could have the long slots.

Figure 6:
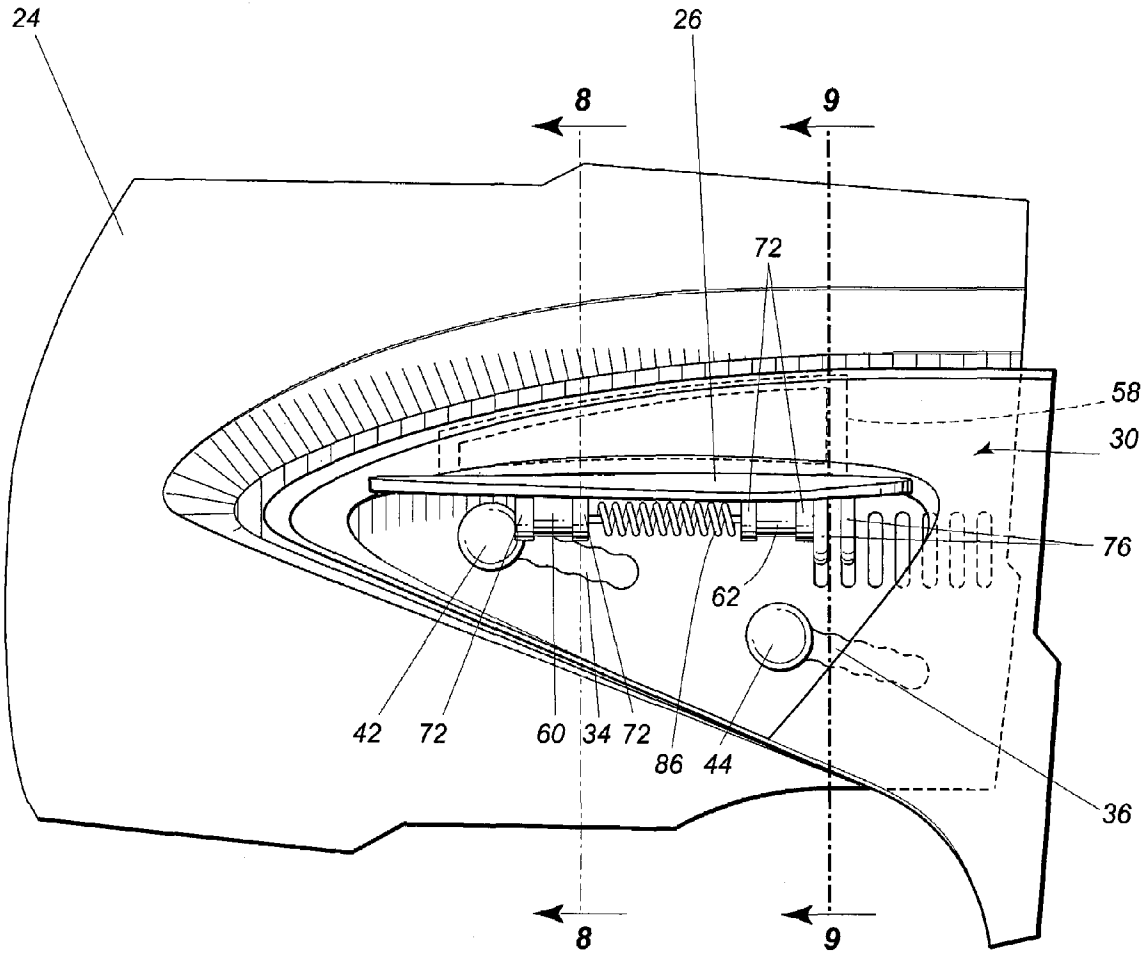
FIG. 6 is a front elevation of the locking device shown in isolation.

Slots 34 and 36 determine the path of movement of front shell 22 and back shell 24 with respect to each other. As can be seen in FIGS. 3, 4 and 6, in a preferred embodiment, slots 34 and 36 are oriented in a slightly downward sloping direction from the back to the front of helmet 20. Alternatively, slots 34 and 36 may be positioned at any angle depending on how front shell 22 and back shell 24 are designed to move in relation to each other. As long as slots 34 and 36 guide front shell 22 and back shell 24 into positions that provide a number of comfortable helmet sizes, they can be in almost any orientation.

Figure 9B:
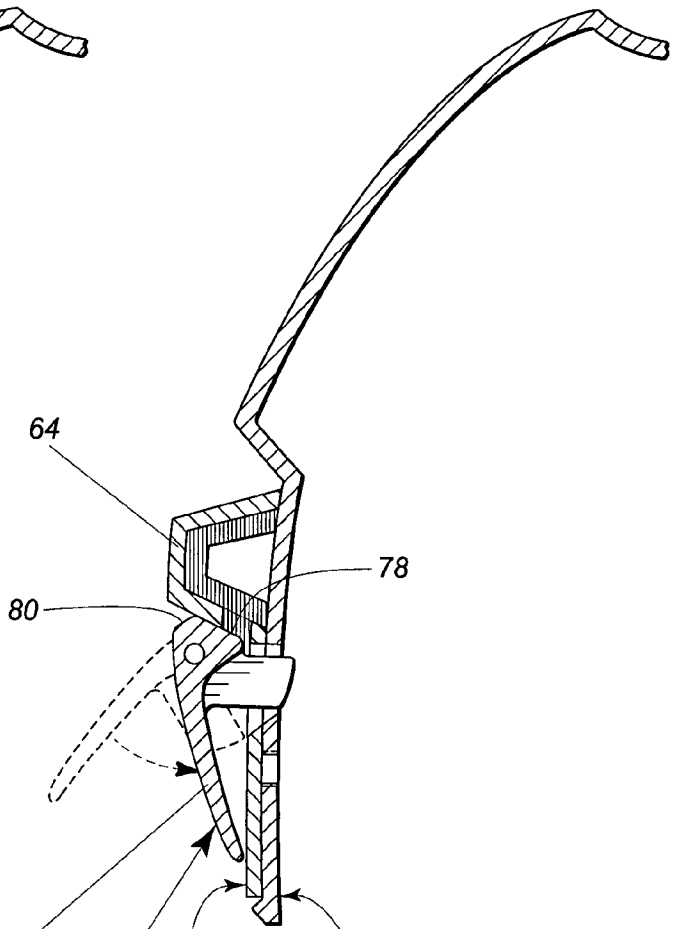
FIG. 9*b* is a cross-section of the locking device taken along line 9—9 shown in FIG. 6, with the locking device in the closed position.

Once a wearer has selected a desired helmet size, front shell 22 and back shell 24 must be securely locked in place so that they are unable to move in relation to each other. For this purpose, adjustable helmet 20 comprises a locking device 26. As can be seen in FIG. 6, locking device 26 comprises two teeth 76, and is pivotally attached to wing 30 of front shell 22. Locking device 26 is movable between a release position and a locked position. In the locked position, as can be seen in FIG. 9*b*, locking device 26 is closed so that teeth 76 engage both sets of anchoring holes 52 and 54 thereby blocking all movement between front shell 22 and back shell 24. In the release position, as shown in FIG. 6, locking device 26 is opened so that teeth 76 do not engage anchoring holes 54 and 52, and front shell 22 and back shell 24, can move in relation to each other so that the helmet size can be adjusted.

The construction and operation of locking device 26 will now be described in more detail. Referring back to FIGS. 1 and 2, it can be seen that locking device 26 is located at the tip of wing 30. The assembly of locking device 26 is best illustrated by FIG. 5, which shows that locking device 26 fits inside indented groove 56 of front shell 22. A hinge element 58 is located underneath the raised portion 64 of wing section 30 (also shown in FIG. 6) and has two attachment members 60 and 62 that extend through wing 30 into indented groove 56. Attachment members 60 and 62 attach locking device 26 to helmet 20 and act as the pivot points on which locking device 26 rotates.

As can be seen in FIGS. 1 through 6, in a preferred embodiment, locking device 26 is in the aesthetically pleasing shape of a rounded scalene triangle. Locking device 26 has three unequal sides. As seen in FIG. 5 the longest side 67 of the triangle is the side that is pivotally connected to hinges 62 and 64. The shortest side 66 is the side that is shielded by the outer surface of wing 30 when locking device 26 is in the locked position. And finally, the third middle-length side 68 is the side that can be held by the wearer to move locking device 26 between its locked position and its release position.

Figures 7, 8:
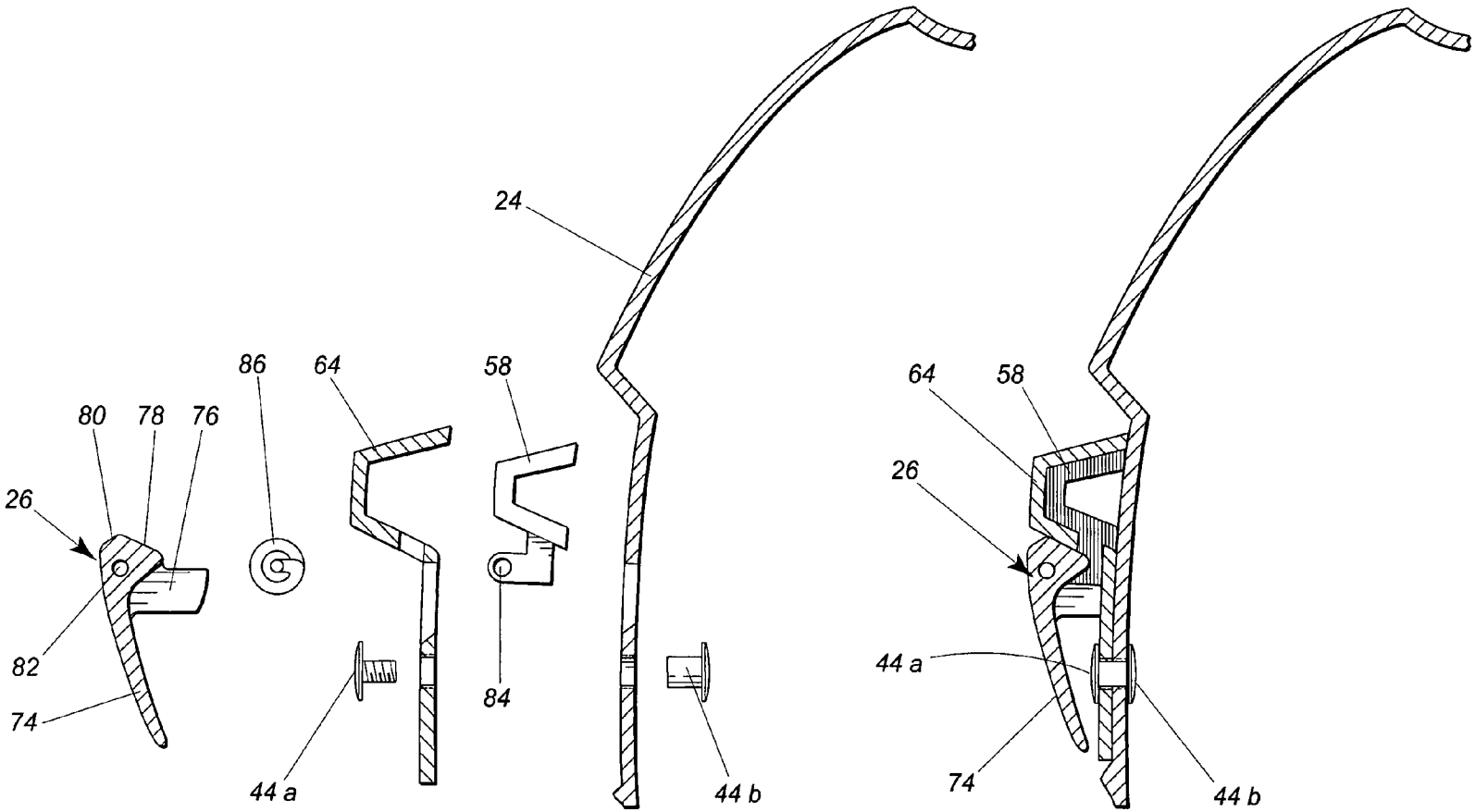
FIG. 7 is an exploded side view of the locking device.
FIG. 8 is a cross-section of the locking device taken along line 8—8 shown in FIG. 6, with the locking device in the closed position.
Figure 9:
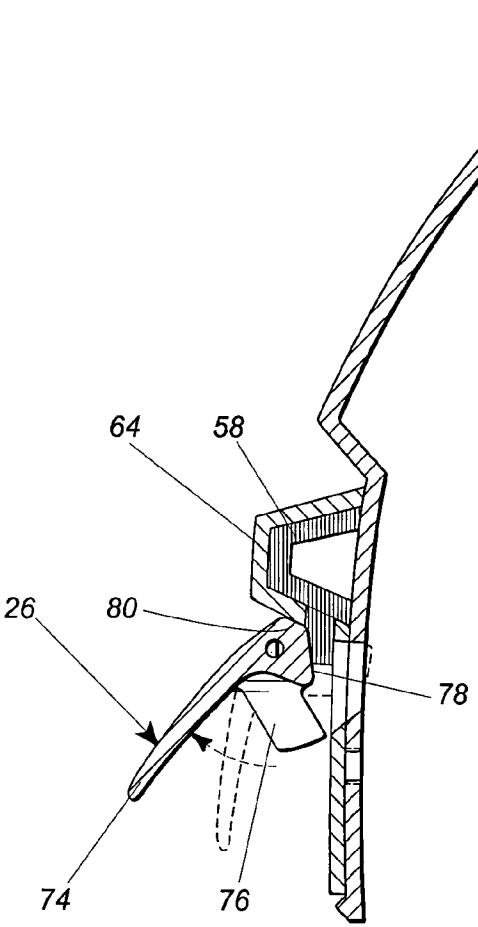
FIG. 9 is a cross-section of the locking device taken along line 9—9 shown in FIG. 6, with the locking device in the open position.

As illustrated in FIGS. 6 and 7, locking device 26 comprises four main components, namely cam surfaces 78 and 80, clevis members 72, a handle 74 and anchoring teeth 76. Closed cam surface 78 and open cam surface 80 can be seen in FIG. 9*b*, which shows locking device 26 in its locked position. When in the locked position, closed cam surface 78 rests against the raised surface 64 of wing 30. And as can be seen in FIG. 9, when locking device 26 is in its release position, open cam surface 80 rests against the raised surface 64 of wing 30. In the release position cam surface 80 ensures that locking device 26 does not fall back into the locked position inadvertently.

Figure 10:
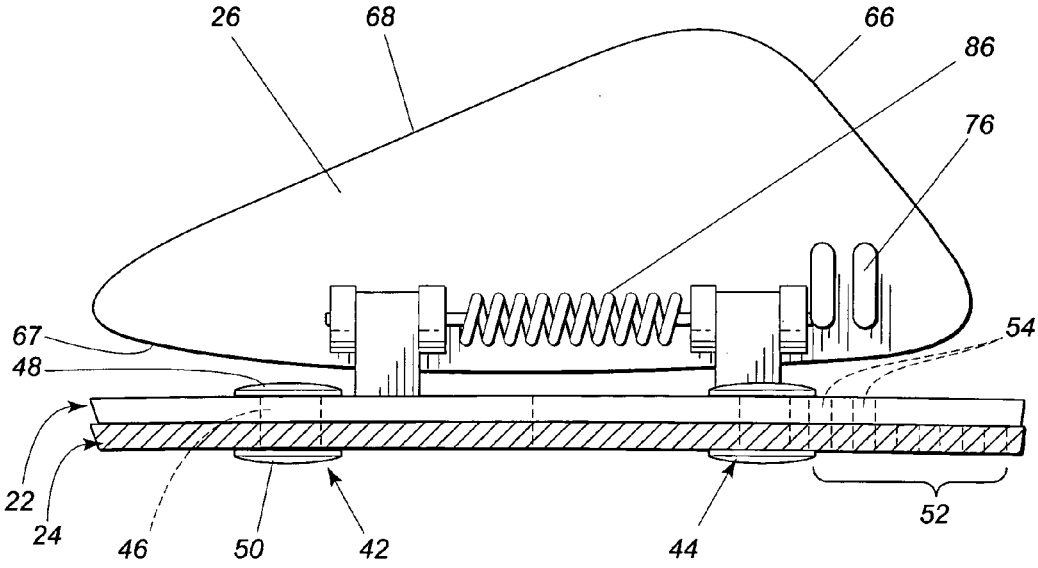
FIG. 10 is a front elevation of the locking device in the open position.
Figure 11:
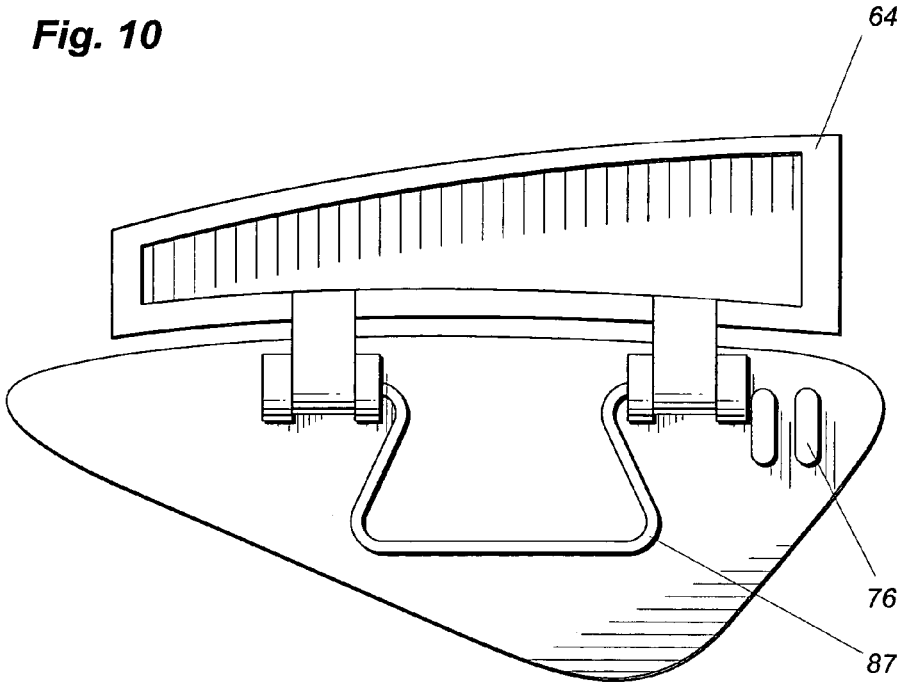
FIG. 11 is a front, elevation of the locking device showing an alternative embodiment of the locking.

The four clevis members 72 that fit around hinge members 60 and 62 can be seen clearly in FIG. 6. Each clevis member 72 comprises a hole 82 that lines up with holes 84 in hinge members 60 and 62. Once clevis members 72 are positioned around hinge members 60 and 62 so that holes 82 and 84 line up, a pin-like device 86 is slid through the holes, thereby attaching locking device 26 to helmet 20. In a preferred embodiment, as can be seen in FIG. 10, pin-like member 86 is in the form of a coiled spring clip that is in its rest position when it is inserted inside holes 82 and 84. This ensures that pin 86 will not fall out accidentally, since it would need to be manually compressed in order to be removed. In an alternate embodiment, shown in FIG. 11, the pin is a wire clip 87 in the shape of a dovetail.

As can be seen in FIG. 10, teeth 76 of locking device 26 are located towards the short side 66 of the scalene triangle. In a preferred embodiment of the invention there are two teeth 76 that in the locked position engage with the series of anchoring holes 52 and 54. Teeth 76 ensure that front shell 22 and back shell 24 are securely locked together when locking device 26 is in the locked position. It should be expressly understood that locking device 26 may include as many or as few teeth as is necessary to adequately secure front shell 22 and back shell 24 together.

The final section of locking device 26 is handle 74 that can be seen clearly in FIGS. 7 through 9*b*. handle 74 extends from side 67 to the surfaces of both the short side 66 and the middle-length side 68. Handle 74 is held by the wearer at middle length side 68 in order to move locking device 26 between its locked position and its release position.

As described above, both front shell 22 and back shell 24 each comprise anchoring holes 54 and 52 that are adapted to lie on top of each other. When helmet 20 is positioned in its largest size, the two forward-most anchoring holes 53, which are shown in FIG. 5, will be in alignment with the two holes 54 of front shell 22. Similarly, when helmet 20 is positioned in its smallest size, the rear-most holes 51 of back shell 24 will be in alignment with the two holes 54 of front shell 22.

In the locked position shown in FIGS. 8 and 9*b*, teeth 76 engage holes 54 of front shell 22 and any two consecutive holes of the series of holes 52. In the release position shown in FIGS. 9 and 10, teeth 76 of locking device 26 are not inserted within the two holes 54 of front shell 22, nor any of the series of holes 52 of back shell 24. Therefore, in the release position the wearer is able to easily slide front shell 22 and back shell 24 with respect to each other in order to establish a desired helmet size. It is clear from FIGS. 9 and 10 that when locking device 26 is in the release position, there is nothing to interfere with the sliding movement of the two shells. In the locking device of the prior art helmets, the helmets have extruding ridges and teeth that rub against each other, causing undue friction and limiting the movement of the two shells when the wearer wishes to adjust the helmet size.

It should also be noted that slots 34 and 36, that receive pins 42 and 44 are in a wavy shape that creates enlarged areas and contracted areas. This shape facilitates the movement of pegs 42 and 44 within slots 34 and 36 so that when pegs 42 and 44 are guided into the enlarged portions of slots 34 and 36, the anchoring holes 54 of front shell 22 are aligned with the anchoring holes 52 of back shell 24.

In operation, a wearer who puts on helmet 20 and realizes that it is too large or too small, does not need to remove helmet 20. The wearer must simply reach up and grasp handle 74 and pull upwards so that locking device 26 moves into the release position. Once locking device 26 is in the release position, the wearer can expand or contract the size of helmet 20 by pushing or pulling shells 24 and 22 in relation to each other. As the two shells move, pegs 42 and 44 move from enlarged portion to enlarged portion within wavy slots 34 and 36. Pegs 42 and 44 will naturally jump from one enlarged portion to another within wavy slots 34 and 36 which correspond to the positions at which teeth 76 naturally align with holes 52 and 54. Therefore, the wearer will be able to align teeth 76 with holes 52 and 54 by feel, since when the wearer is not pulling or pushing, pegs 42 and 44 will naturally be in a position that aligns teeth 76 with holes 52 and 54.

The above description of preferred embodiments should not be interpreted in a limiting manner since other variations, modifications and refinements are possible within the spirit and scope of the present invention. The scope of the invention is defined in the appended claims and their equivalents.

What is claimed is:

1. An adjustable helmet comprising:

a first shell having smooth interference-free sliding surfaces and at least one anchoring hole;

a second shell having smooth interference-free sliding surfaces and a series of at least two anchoring holes, said second shell being adjustably connected to said first shell so that said smooth interference-free sliding surfaces of said two shells fit together in an overlapping relationship; and a manually operable locking device comprising at least one tooth, said locking device being movable between a locked position and a release position so that:

a) in said locked position, said at least one tooth engages said at least one anchoring hole of said first shell, as well as at least one hole of said series of at least two anchoring holes of said second shell thereby locking said first and second shells together; and b) in said release position, said at least one tooth does not engage said series of at least two anchoring holes of said second shell, thereby allowing said first shell and said second shell to move in relation to each other along their smooth, interference-free sliding surfaces.

2. An adjustable helmet as defined in claim 1, wherein said locking device further comprises:

a cam member adapted to pivot about an axis that extends in a direction parallel to a side portion of said adjustable helmet; and a handle that extends from said cam member and is adapted to allow a user to move said locking device between said locked position and said release position.

3. An adjustable helmet as defined in claim 2, wherein said first shell comprises a top section adapted to lie on top of the wearer's head, and two wing sections adapted to extend around sides of the wearer's head.

4. An adjustable helmet as defined in claim 3, wherein said smooth interference-free sliding surfaces of said first shell are located on an outside surface of said top section of said first shell, and on an inside surface of said two wing sections.

5. An adjustable helmet as defined in claim 4, wherein said smooth interference-free sliding surfaces of said second shell are located on an interior surface of a top of said second shell, and on an exterior surface of sides of said second shell.

6. An adjustable helmet as defined in claim 2, wherein in said release position said handle of said locking device extends substantially perpendicular from a surface of said first shell.

7. An adjustable helmet as defined in claim 1, wherein in said locked position, said locking device has a top surface which lies flush with a surface of said first shell.

8. An adjustable helmet as defined in claim 1 wherein said first shell and said second shell are slidably connected by a slot and peg assembly.

9. An adjustable helmet as defined in claim 8 wherein either one of said first shell and said second shell has an expanding and contracting slot for guiding movement of said shells in relation to each other.

10. An adjustable hockey helmet comprising:

a front shell having smooth interference-free sliding surfaces and anchoring holes;

a back shell having smooth interference-free sliding surfaces and anchoring holes, said back shell being adjustably connected to said front shell so that said smooth interference-free sliding surfaces of said shells fit together in an overlapping relationship;

a locking device comprising at least one tooth, said locking device being movable between a locked position and a release position so that:

a) in said locked position said at least one tooth engages said anchoring holes of said front shell, as well as said anchoring holes of said back shell thereby locking said first and second shells together; and b) in said release position, said at least one tooth does not engage said anchoring holes of said back shell, thereby allowing said front shell and said back shell to move in relation to each other along their smooth, interference-free sliding surfaces.

11. An adjustable hockey helmet as defined in claim 10, wherein said locking device is manually operable and further comprises:

a cam member adapted to pivot about an axis tat extends in a direction parallel to a side portion of said adjustable helmet; and a handle that extends from said cam member and is adapted to allow a user to move said locking device between said locked position and said release position.

12. An adjustable hockey helmet as defined in claim 11, wherein said front shell comprises a top section adapted to lie on top of the wearers head, and two wing sections adapted to extend around sides of the wearer's head.

13. An adjustable hockey helmet as defined in claim 12, wherein said smooth interference-free sliding surfaces of said front shell are located on an outside surface of said top section of said front shell, and on an inside surface of said two wing sections.

14. An adjustable hockey helmet as defined in claim 13, wherein said smooth interference-free sliding surfaces of said back shell are located on an interior surface of a top of said back shell, and on an exterior surface of sides of said back shell.

15. An adjustable hockey helmet as defined claim 11, wherein in said release position said handle of said locking device extends substantially perpendicular from a surface of said front shell.

16. An adjustable hockey helmet as defined in claim 10, wherein in said locked position a top surface of said locking device lies flush with a surface of said front shell.

17. An adjustable hockey helmet comprising:

a back shell having a smooth interference-free sliding surface and two sides, wherein each side comprises two elongated slots and a series of anchoring holes, a front shell having a smooth interference-free sliding surface and two sides, wherein each side comprises a wing element adapted to overlap said interference-free sliding surface of said back shell, two slots and two anchoring holes; said front shell and said back shell movably connected to each other by a peg inserted within said two elongated slots of said back shell and said two slots of said front shell, said front shell further comprising:

a manually operated locking device mounted to said wings, said locking device having two teeth and movable between a locked position and a release position, wherein a) in said locked position said two teeth engage said two anchoring holes of said front shell and two holes of said series of holes of said back shell, thereby locking said first and second shells together; and b) in said release position said two teeth do not engage said series of anchoring holes of said back shell, thereby allowing said front shell and said back shell to move in relation to each other along their smooth, interference-free sliding surfaces.

18. An adjustable helmet comprising:

a first shell having smooth interference-free sliding surfaces and at least one anchoring hole;

a second shell having smooth interference-free sliding surfaces and a series of at least two anchoring holes, said second shell being adjustably connected to said first shell so that the smooth interference-free sliding surfaces of said shells fit together in an overlapping relationship; and a locking device comprising at least one tooth, said locking device being movable between a locked position and a release position so that:

a) in said locked position, said at least one tooth engages said at least one anchoring hole of said first shell, as well as at least one hole of said series of at least two anchoring holes of said second shell thereby locking said first and second shells together; and b) in said release position, said at least one tooth does not engage said series of at least two anchoring holes of said second shell, thereby allowing said first shell and said second shell to move in relation to each other along their smooth, interference-free sliding surfaces.

* * * * *